US008615890B2

(12) United States Patent
Wolf et al.

(10) Patent No.: US 8,615,890 B2
(45) Date of Patent: Dec. 31, 2013

(54) CHAIN SAW

(75) Inventors: Günter Wolf, Oppenweiler (DE); Maximilian Eberhardt, Esslingen (DE); Wolfgang Weissert, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 388 days.

(21) Appl. No.: 13/052,526

(22) Filed: Mar. 21, 2011

(65) Prior Publication Data

US 2011/0232110 A1 Sep. 29, 2011

(30) Foreign Application Priority Data

Mar. 25, 2010 (DE) ..... 10 2010 012 748

(51) Int. Cl.
*B27B 17/02* (2006.01)

(52) U.S. Cl.
USPC ..... 30/383; 30/386

(58) Field of Classification Search
USPC ..... 30/381–387
See application file for complete search history.

(56) References Cited

U.S. PATENT DOCUMENTS

| | | | | |
|---|---|---|---|---|
| 3,870,125 | A * | 3/1975 | Gorski | 184/15.1 |
| 4,129,943 | A * | 12/1978 | Bricker | 30/386 |
| 5,353,506 | A * | 10/1994 | Muller et al. | 30/386 |
| 6,256,890 | B1 * | 7/2001 | Schliemann et al. | 30/386 |
| 2006/0120796 | A1 * | 6/2006 | Kobayashi et al. | 403/14 |
| 2008/0034597 | A1 * | 2/2008 | Pfleiderer et al. | 30/382 |
| 2009/0007748 | A1 * | 1/2009 | Galster | 83/820 |

* cited by examiner

*Primary Examiner* — Stephen Choi
(74) *Attorney, Agent, or Firm* — Walter Ottesen P.A.

(57) ABSTRACT

A chain saw includes a guide bar for a saw chain, a housing, a sprocket wheel cover, and a stud fixed on the housing for threadably fastening the sprocket wheel cover and the guide bar. The free thread end of the stud has a maximum usable screw-in depth ($t_{max}$) for a nut. A stop for the sprocket wheel cover having a stop surface as well as a support surface for contact engaging the stop surface are provided. In the mounted state of the guide bar, a distance (a) remains between the stop surface and the support surface. The support surface contact engages the stop surface when the guide bar is removed and the nut is tightened and screwed onto the studs to a stop screw-in depth. The stop is configured in such a manner that the maximum usable screw-in depth ($t_{max}$) is greater than the stop screw-in depth.

12 Claims, 4 Drawing Sheets

State of the Art

CHAIN SAW

CROSS REFERENCE TO RELATED APPLICATION

This application claims priority of German patent application no. 10 2010 012 748.5, filed Mar. 25, 2010, the entire content of which is incorporated herein by reference.

BACKGROUND OF THE INVENTION

Handheld chain saws include a saw chain which revolves around the periphery of a guide bar. To drive the saw chain, a sprocket wheel having an externally toothed gear, which is driven by a drive motor, is provided. The external teeth of the sprocket wheel engage between the members of the saw chain and drive them.

The drive shaft of the sprocket wheel is mounted in a housing of the chain saw. A sprocket wheel cover which covers the area of the sprocket wheel is threadably engaged with the housing. At least one stud, which in its mounted state is guided through an opening of the sprocket wheel cover, is fixed to the housing for the threaded fastening. A nut is screwed onto a free thread end of the stud and presses the sprocket wheel cover against the housing.

The guide bar of the saw chain is strung onto the stud, of which there is at least one, and is held clamped between the housing and the sprocket wheel cover. The sprocket wheel cover also has a holding function for the guide bar aside from its protective function.

The sprocket wheel cover is removed for maintenance work on the guide bar or the saw chain or for changing the same components, and also for the space-saving storing of the chain saw; the guide bar including the saw chain can be removed or exchanged. For assembly, first the guide bar is strung onto the at least one stud and then the sprocket wheel cover is attached in such a manner that the at least one stud projects through the opening in the sprocket wheel cover. For completion of assembly, the nut is threaded onto the free thread portion of the stud and tightened. The free thread end of the stud has a maximum usable screw-in depth for the nut. The tightened nut is threadably engaged with an operating screw-in depth that is smaller than the maximum screw-in depth, so that a sufficient tolerance in the tightening direction of the nut remains for the effective tightening without damaging the arrangement.

If the guide bar is removed for extended periods of time, for example for transport or maintenance work, the sprocket wheel cover is re-applied and screwed on even without the guide bar. Thus, it is ensured that the sprocket wheel cover remains on the chain saw. Thus, the sprocket wheel cover will be handy during any later assembly and cannot get lost. In practice, however, it turns out that the at least one nut for fixing the sprocket wheel cover is often pulled too tight when the guide bar is removed. As a result, the sprocket wheel cover and the nut may tilt and become damaged. Depending on the configuration of the arrangement, the actual screw-in depth can exceed the permissible maximum screw-in depth, so that the result can be damage done to the threads on the studs and on the nuts. It is even possible that the studs are ripped out of their anchoring in the housing.

SUMMARY OF THE INVENTION

It is an object of the invention to provide a chain saw of the type described above wherein the sprocket wheel cover can also be applied and screwed down without any danger of overstressing the arrangement when the guide bar has been removed.

The chain saw of the invention includes: a guide bar for a saw chain; a housing; a sprocket wheel cover; at least one stud fixed to the housing configured for threadably fastening the sprocket wheel cover to the housing with the guide bar clamped between the sprocket wheel cover and the housing; the stud having a free threaded end; a nut configured to threadably engage the free threaded end of the stud; the free threaded end having a maximum usable screw-in depth ($t_{max}$) for the nut; a stop for the sprocket wheel cover; the stop having a stop surface; a support surface for contact engaging the stop surface; the stop surface being at a distance (a) to the support surface when the guide bar and the sprocket wheel cover are mounted and the nut is tightened; the support surface contact engaging the stop surface of the stop when the guide bar is removed and the nut is tightened and threadably engaging the stud to a stop screw-in depth ($t_2$); and, the stop being so configured that the maximum usable screw-in depth ($t_{max}$) is greater than the stop screw-in depth ($t_2$).

It is suggested to provide a stop for the sprocket wheel cover having a stop surface as well as a support surface for contact engaging the stop surface. In the assembled state of the guide bar and the sprocket wheel cover, a distance remains between the stop surface and the support surface when the nut is tightened. The support surface contacts the stop surface of the stop when the guide bar is missing and the nut is tightened, and thus the nut is screwed onto the stud with a stop screw-in depth. The stop is configured such that the maximum usable screw-in depth is larger than the screw-in depth of the stop.

The distance between the stop and the support surface ensures that the stop has no effect when the guide bar is mounted and the at least one nut can be screwed onto the stud and tightened to such an extent that the guide bar is reliably held clamped between the sprocket wheel cover and the housing. When the guide bar is missing, the nut screwed on tightens the sprocket wheel cover to such an extent that the support surface contacts the stop surface of the stop. The stop is configured in such a manner that the sprocket wheel cover does not tilt and sustain damage here. The nut does not tilt either. The stop further prevents the nut from being screwed down beyond the maximum permissible screw-in depth or the maximum usable screw-in depth. In fact, the maximum usable screw-in depth is larger than the stop screw-in depth, so that the studs and the nut including their outer and inner threads remain undamaged.

In a preferred embodiment of the invention, the stop has a stop surface and the sprocket wheel cover has a support surface corresponding to the stop surface. The stop surface and the support surface are at least approximately perpendicular to a longitudinal axis of the stud. The perpendicular alignment leads to contact forces acting exclusively in parallel to the longitudinal axis of the stud without any directional components transversely thereto. The sprocket wheel cover and the arrangement collectively remain free from transverse forces, so that the sprocket wheel cover does not slide sideways and remains tilt-free upon tightening of the sprocket wheel cover.

The stop is preferably formed by a screw head. It can be expedient to arrange the stop on the sprocket wheel cover or on another component of the chain saw. In an advantageous alternate embodiment, the stop is arranged on the housing and in particular is formed by the head of that screw via which a side plate is fixed as a support for the guide bar. The construction is simple and effective in structure. By using the fixing screw of the side plate also as a stop, the former has a double function, so that additional components can be avoided along with any additional costs associated therewith.

In an advantageous embodiment, the guide bar has an opening which the stop projects into in the mounted state of the guide bar. Thus, it is ensured that the guide bar does not collide with the stop when in the mounted state. Any incorrect Mounting of the guide bar is avoided. At the same time, it is ensured that the stop remains without effect in the desired way when the guide bar is mounted and has the desired effect only when the guide bar is missing.

It has been shown to be practical that the distance between the stop surface and the support surface in the mounted state of the guide bar is at least 0.2 mm and advantageously is 2.0 mm at maximum. The minimum distance ensures that even when dirt is accumulated during operation and when the guide bar is mounted there is no interaction between the stop and the sprocket wheel cover, so that a reliable clamping is ensured. Limiting the maximum distance means the sprocket wheel cover cannot be stressed or overly stressed when the guide bar is missing.

In a preferred embodiment, the tightened nut is threadably engaged with an operating screw-in depth when the guide bar and sprocket wheel cover are in the mounted state. The maximum usable screw-in depth is at least 1.5 mm larger than the operating screw-in depth. Thus, a sufficient tolerance remains in the screw-in direction by means of which the guide bar can be reliably clamped without damaging the inner or outer threads of the screw connection.

The nut is expediently a collar nut that is captive, rotatable, and held with play in an opening of the sprocket wheel cover. When placing the sprocket wheel cover, the nut is on-the-spot and cannot get lost. When the guide bar is mounted or missing, the nut is brought directly to the location of the screw connection upon placement of the sprocket wheel cover and can be screwed on without being damaged or stressed.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
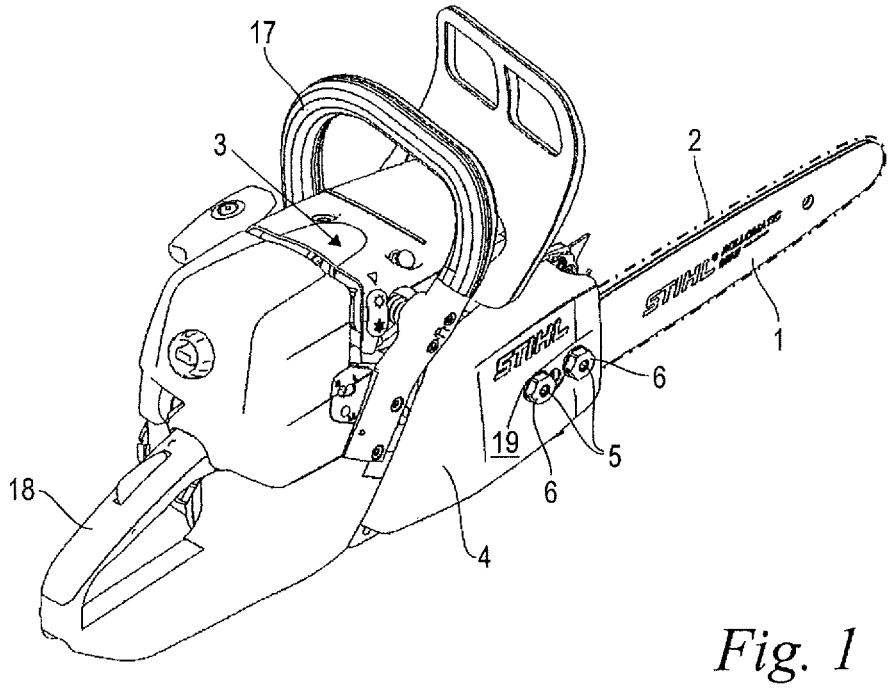
FIG. 1 is a perspective view of a chain saw having a housing and a sprocket wheel cover screwed onto the housing and holding a guide bar clamped in an intermediate position.

FIG. 1 shows a handheld, motor-driven chain saw. The chain saw includes a housing 3 in which a drive motor, not shown, is arranged. In the shown embodiment, the drive motor is a two-stroke combustion engine but can also be a four-stroke engine. An electric motor can also be provided in place of the combustion engine. A guide bar 1 protruding forwards from the housing 3, in relation to the usual operating position, is arranged laterally of the housing 3. A saw chain 2 driven by the drive motor is circulatingly guided about the outer edge of the guide bar 1. A front handle 17 is arranged toward the center above the housing 3. A back handle 18 is provided on the rear end of the housing 3 which is opposite to the guide bar 1. The chain saw is carried and guided by hand via the handles (17, 18) during operation.

The drive motor drives a sprocket wheel, not shown, whose external teeth engage between the links of the saw chain 2 and thus set the saw chain 2 in motion. The sprocket wheel and a section of the guide bar 1 adjacent to the sprocket wheel are covered by the sprocket wheel cover 4. At least one stud, here two studs 5, are fixed to the housing 3. Respective nuts 6 threadably engage the studs 5 on the exterior side 19 of the sprocket wheel cover 4. The nuts 6 press the sprocket wheel cover 4 against the housing 3, with the guide bar 1 being clamped and fixed between the sprocket wheel cover 4 and the housing 3.

Figure 2:
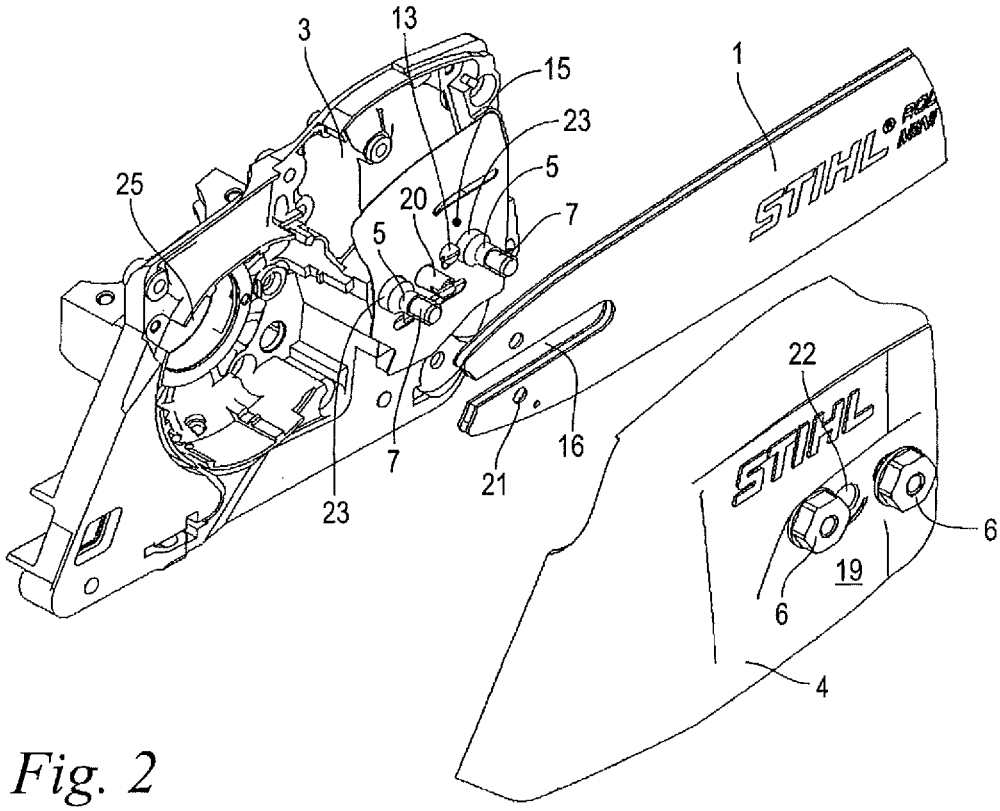
FIG. 2 is an exploded view of the arrangement of FIG. 1 in the region of the sprocket wheel cover with details regarding the arrangement of the guide bar and studs for fastening the sprocket wheel cover.
Figure 3:
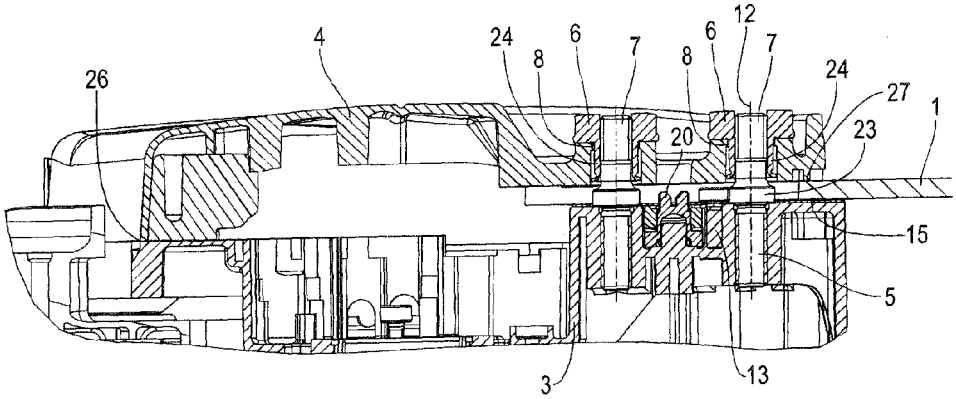
FIG. 3 is a longitudinal section view of the assembled arrangement according to FIGS. 1 and 2 with further details as to the mutual positioning of housing, guide bar, sprocket wheel cover, studs and nuts.

FIG. 2 shows an exploded view of the arrangement of FIG. 1 in the region of the sprocket wheel cover 4. FIG. 3 shows a longitudinal section of the arrangement of FIG. 2 in the assembled state. FIGS. 2 and 3 viewed in combination show that the housing. 3 has a bearing opening 25 through which a drive shaft, not shown, together with a sprocket wheel, not shown either, is passed through in the assembled state. Two studs 5 are fixed to the housing 3 towards the front in the direction of the guide bar 1, as viewed from the bearing opening 25. The two studs 5 are guided through openings 8 in the side wall of the sprocket wheel cover 4 to the exterior side 19 thereof, and each have free thread ends 7 on their ends facing the exterior side 19 of the sprocket wheel cover 4 on which the nuts 6 are screwed onto. According to FIG. 4, the nuts 6 are captive, rotatable, and designed as collar nuts having a collar 24, which nuts are held with play in the opening 8 of the sprocket wheel cover 4. The collar 24 is beaded radially outwardly at its end facing the housing 3, so that the nuts 6 cannot fall out of the opening 8.

A portion of the housing 3 is a side plate 15 made of steel plate which can be fixed on a plastic base body of the housing 3 via a screw 13. An adjusting screw 20 for a chain tensioner, not shown in detail, is arranged between the two studs 5. The studs 5 and the adjusting screw 20 are guided through corresponding openings of the side plate 15. In the assembled state, the guide bar 1 is clampingly pressed against the side plate 15 of the housing 3 by the sprocket wheel cover 4. FIG. 3 shows that the sprocket wheel cover 4 has a back cover edge 26, which is opposite the two studs 5 in the longitudinal direction, and a front cover edge 27 adjacent to the two front studs 5. When the nuts 6 are tightened, the sprocket wheel cover 4 is pressed against the housing 3 with its back cover edge 26 and is pressed against the guide bar 1 with its front cover edge 27. Thus, the guide bar 1 is pressed against the housing 3 and is clampingly held thereby.

On its end facing the bearing opening 25, the guide bar has a slot-shaped opening 16 extending in the direction of the longitudinal axis of the guide bar 1. In the assembled state, the two studs 5 pass through the slot-shaped opening 16 and allow for a longitudinal displaceability of the guide bar 1 in the direction of its longitudinal axis when the nuts are loosened.

The studs 5 have an annularly peripheral thickened part 23, whose diameter is larger than the diameter of the free thread ends 7, adjacent to the side plate 15. The diameter of the thickened parts 23 corresponds to the diameter inside of the slot-shaped opening 16, so that when the guide bar is mounted, the thickened parts 23 come to rest at least approximately free of play in the slot-shaped opening 16. Hereby, the guide bar 1 is fixed in a precise position relative to the housing 3. Only a single degree of freedom of movement remains for the guide bar 1 relative to the housing 3, namely in the longitudinal direction of the guide bar 1 for setting the chain tension.

The guide bar 1 is provided with a bore 21 above the slot-shaped opening 16 and a bore 21 below the slot-shaped opening 16. In the assembled state, a pin (not shown) of the chain tensioner (not shown either) engages in the lower bore 21. By actuating the chain tensioner via the adjusting screw 20, the guide bar 1 can be displaced in the direction of its longitudinal axis and thereby be adjusted to such an extent that the desired tension in the saw chain 2 (FIG. 1) is set when the sprocket wheel cover 4 is at least partially loosened or the nut 6 is at least partially loosened. After completely loosening the nut 6, the sprocket wheel cover 4 can be removed from the housing 3, which enables a disassembly and/or changing of the guide bar 1 or a changing of the saw chain 2 (FIG. 1).

Figure 4:
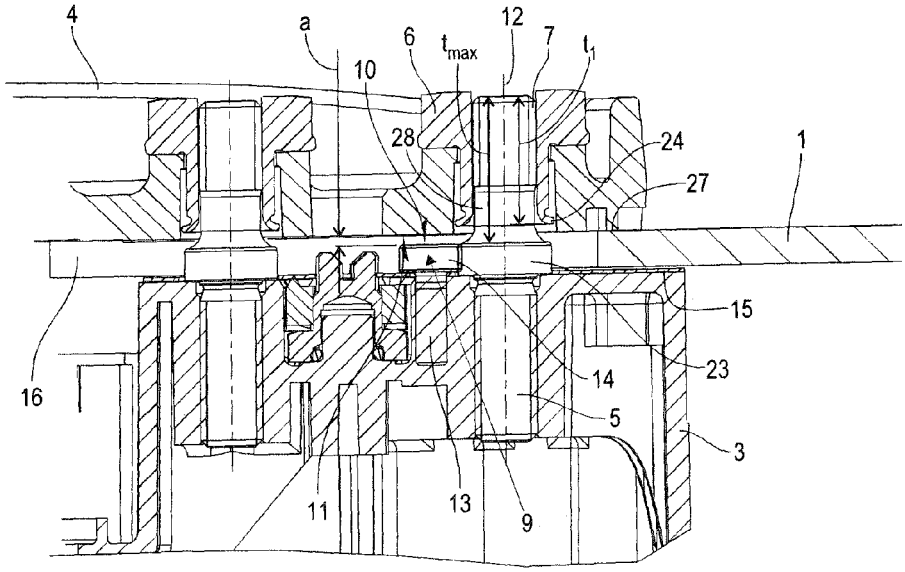
FIG. 4 is an enlarged view of the arrangement of FIG. 3 in the region of the studs with a mounted guide bar and with the details as to the stop arranged on the housing for the sprocket wheel cover.

FIG. 4 shows an enlarged view of the arrangement of FIG. 3 in the region of the studs 5. According to the invention, a stop 9 is provided for the sprocket wheel cover 4. The stop 9 is arranged and fixed to the housing 3 in the embodiment of FIG. 4. For this, different appropriate configurations can be considered, for example, a one-piece nose or the like integrally formed on the housing 3. In the shown embodiment, the stop 9 is formed by the head 14 of a screw. For this, a separate screw screwed into the housing 3 can be provided. According to FIG. 4, the head 14 of that screw 13, via which the side plate 15 is screwed on the base body of the housing 3, is provided as the stop 9. When the guide bar 1 is mounted, the head 14 projects into the slot-shaped opening 16 of the guide bar 1 without protruding beyond the guide bar 1 on the side of the sprocket wheel cover 4. Moreover, the height of the head 14 is less than the thickness of the guide bar 1, so that a distance (a) remains between the head 14 and the sprocket wheel cover 4 when the guide bar 1 is mounted. When the guide bar 1 and the sprocket wheel cover 4 are mounted there is no interaction between the stop 9 and the sprocket wheel cover 4.

Nevertheless, the head 14 of the screw 13, that is, its free abutting face forms a stop surface 10 while a support surface 11 is formed opposite thereto on the sprocket wheel cover 4. The stop surface 10 of the stop 9 and the corresponding support surface 11 of the sprocket wheel cover 4 are arranged perpendicularly to the longitudinal axes 12 of the studs 5 and are positioned relative to one another at the aforementioned distance (a). Their function and effect will be described below in relation to FIG. 6.

From FIG. 4 it can be seen that a thread-free section 28 is optionally provided between the free thread end 7 and the thickened part 23 of the individual studs 5. The diameter of the thread-free section 28 is smaller than the outer diameter of the free thread end 7 to at least such an extent that the nut 6 can be screwed onto the thickened part 23 beyond the free thread end 7. Of course, it is also possible that the free thread end 7 continuously extends from the outermost end of the stud 5 to the thickened part 23. The lengths of the free thread end 7 and the optional thread-free section 28 predetermine a maximum usable screw-in depth $t_{max}$ for the nut 6, starting from the outer end of the stud 5 up to the thickened part 23.

The two nuts 6 are screwed onto the thread ends 7 of the two studs with an operating screw-in depth $t_1$ to such an extent that the front cover edge 27 rests against the outer side surface of the guide bar 1 and thereby presses the guide bar 1 against the housing 3, that is, against its side plate 15. The operating screw-in depth $t_1$ is measured from the outermost end of the studs 5 up to the housing-side end of the two nuts 6, here up to the housing-side edge of the corresponding collar 24. The maximum usable screw-in depth $t_{max}$ is larger than the operating screw-in depth $t_1$, preferably being at least 1.5 mm larger than the operating screw-in depth $t_1$. This ensures that there is no collision between the nut 6, that is, its collar 24, and the thickened part 23 of the corresponding stud 5. Furthermore, when the guide bar 1 and the sprocket wheel cover 4 are mounted, the distance (a) between the stop surface 10 and the support surface 11 is advantageously at least 0.2 mm and expediently at most 2.0 mm.

Figure 5:
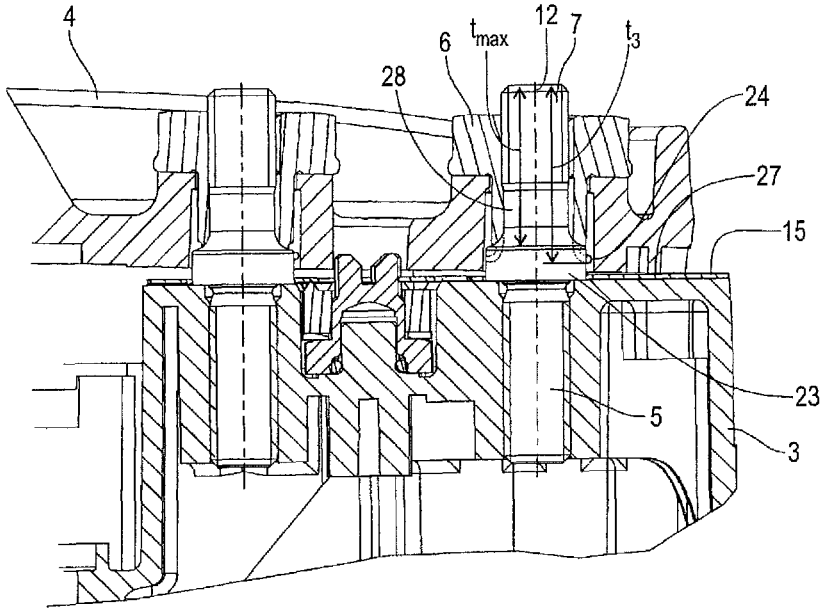
FIG. 5 shows the arrangement of FIG. 4 with the guide bar being removed in an embodiment according to the state of the art.

FIG. 5 shows a variant of the arrangement of FIG. 4 with the guide bar 1 (FIG. 3) removed but with the sprocket wheel cover 4 applied and screwed-on in a configuration according to the state of the art with no stop 9 (FIG. 4). If, in accordance with FIG. 5, the guide bar 1 shown in FIG. 3 is not mounted, the nuts 6 can be screwed onto the studs 5 to such an extent that the front cover edge 27 comes to rest on the housing 3, that is, on the side plate 15. Hereby, the sprocket wheel cover 4 performs a pivot-motion about its back cover edge 26 (FIG. 3), which also rests on the housing 3, and the sprocket wheel cover 4 is thus tilted and tensioned relative to its operating position according to FIG. 3. This also applies to the nut 6, shown in tilted position, which leads to damage done to the sprocket wheel cover 4 and its screw connection.

In the embodiment according to FIG. 5, the two nuts 6 are screwed onto the corresponding studs 5 by an impermissible screw-in depth $t_3$ to such an extent that the front cover edge 27 rests against the housing 3, that is, the side plate 15. The impermissible screw-in depth $t_3$ is larger than the maximum usable and thus permissible screw-in depth $t_{max}$. As a result, the nuts 6 with their portions facing the housing 3, here with their corresponding collars 24, shown in broken lines, collide with each of the corresponding thickened parts 23 of the two studs 5. The impermissible screw-in depth $t_3$ is measured from the outermost end of the corresponding stud 5 up to the housing-side end of the nut 6, here up to the housing-side edge of the collar 24. The nuts 6 and the studs 5, that is, their inner and outer threads, can be damaged because of the collision with the thickened part 23. Furthermore, the studs 5 can be loosened in their mounting on the housing 3 or even be ripped out.

Figure 6:
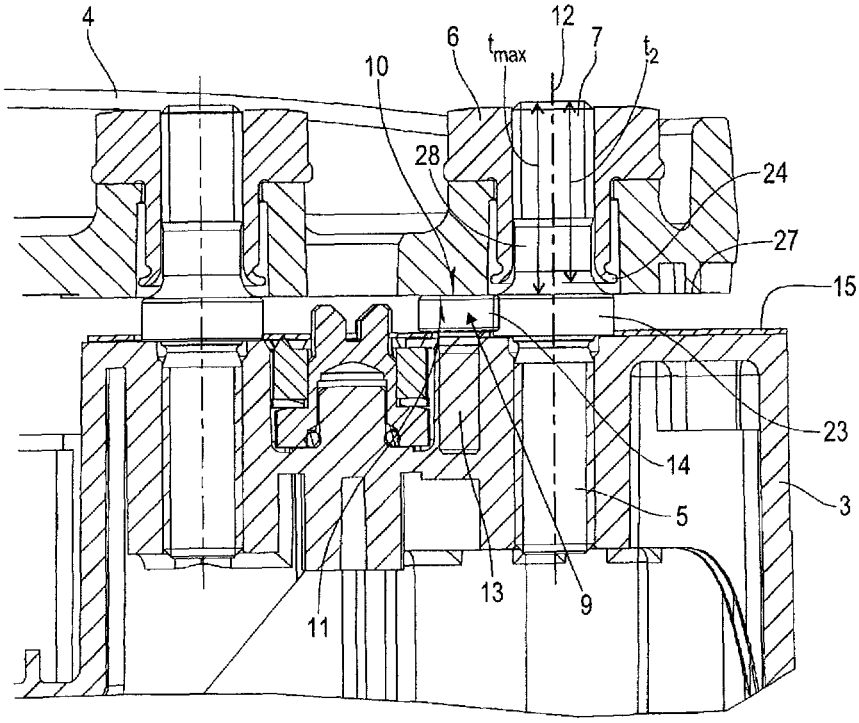
FIG. 6 shows a further embodiment of the arrangement of FIG. 5 with the guide bar missing and with the sprocket wheel cover being pressed against the stop of FIG. 4; and, FIG. 7 is a alternative of the arrangement of FIG. 4 with a stop being arranged on the sprocket wheel cover.

FIG. 6 shows an embodiment of the invention according to FIG. 4, with the guide bar 1 being removed, the sprocket wheel cover 4 screwed onto the housing 3 and the nuts 6 tightened. Departing from the state of the art according to FIG. 5, the front cover edge 27 lies at a distance to the housing 3, that is, to its side plate 15. In fact, the sprocket wheel cover 4 is pressed against the stop surface 10 of the stop 9 with its support surface 11 due to the effect of the tightened nuts 6. Relative to their operating screw-in depth $t_1$, the two nuts 6 are further screwed onto the studs 5 by distance (a) (FIG. 4) so that a stop screw-in depth $t_2$ results. The stop 9 is configured such that the maximum usable or permissible screw-in depth $t_{max}$ is larger than the stop screw-in depth $t_2$. This results in particular from the borders to distance (a), described above in relation to FIG. 4, and to the difference between the maximum usable screw-in depth $t_{max}$ and the operating screw-in depth $t_1$. It is ensured that the nuts 6, that is their collars 24, have a sufficient axial distance from the corresponding thickened part 23 of the studs 5, so that no damage can be done to the nuts 6 and the studs 5 including their inner or outer threads and including the collar 24 or the thickened part 23. Because of the large free distance between the front cover edge 27 of the sprocket wheel cover 4 and the housing 3, the sprocket wheel cover 4 is only minimally tilted in its operating position according to FIG. 3 as compared to the state of the art according to FIG. 5 so that no technically relevant tilting or tensioning will result on the sprocket wheel cover 4, the housing 3, the studs 5 or the nuts 6.

Figure 7:
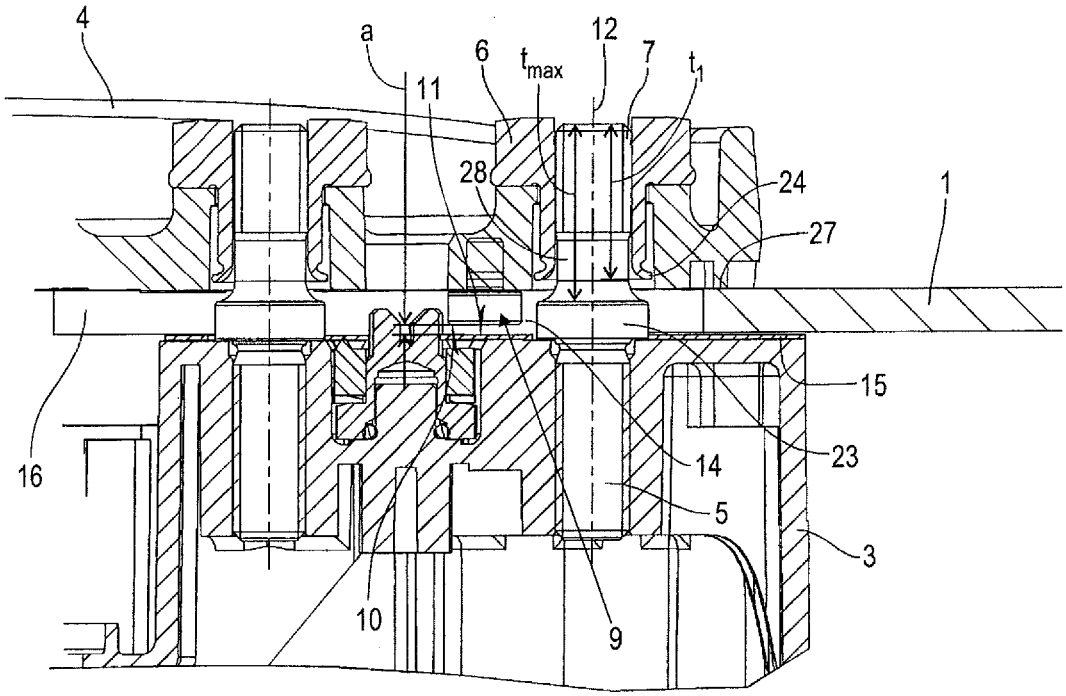

FIG. 7 shows a variant of the arrangement of FIG. 4. In deviation from the embodiment according to FIGS. 1 to 4 and 6, the stop 9 is not arranged or fixed on the housing 3 but on the sprocket wheel cover 4. Vice versa, the support surface 11, which is provided to rest on the stop surface 10 of the stop 9, is not arranged on the sprocket wheel cover 4 but on the opposite lying housing 3.

In the shown embodiment, the stop 9 with its stop surface 10 is formed by a screw screwed into the sprocket wheel cover 4. Of course, other configurations can also be considered in which a differently configured stop 9, for example, in the form of an integrally formed part of the sprocket wheel cover 4 or the like, for example, in the form of a nose, a pin, or the like is provided. As an example, here the support surface 11 is formed by the surface of the side plate 15 which is arranged on the housing; however, it can also be provided by another surface associated with the housing 3.

Just like in the embodiment of FIG. 4, the support surface 11 lies at a distance (a) to the stop surface 10 of the stop 9 when the guide bar 1 is mounted, the sprocket wheel cover 4 is mounted and the nuts 6 are tightened. If analogously to FIG. 6 the guide bar 1 is removed and the sprocket wheel cover 4 is screwed on, the support surface 11 and the stop surface 10 will contact one another, that is, rest against one another, thus resulting in the same conditions as described in relation to FIG. 6. The other features and reference characters in the embodiment of FIG. 7 are the same as those in the embodiments according to FIGS. 1 to 4 and 6.

It is understood that the foregoing description is that of the preferred embodiments of the invention and that various changes and modifications may be made thereto without departing from the spirit and scope of the invention as defined in the appended claims.

What is claimed is:

1. A chain saw comprising:

a guide bar for a saw chain;

a housing having a side surface;

a sprocket wheel cover having a press-on surface facing toward said housing;

at least one stud fixed to said housing configured for threadably fastening said sprocket wheel cover to said housing with said guide bar clamped between said sprocket wheel cover and said housing;

said stud having an outermost end and a free threaded end portion defining a first diameter;

a nut having an end facing toward said housing and being configured to threadably engage said free threaded end portion of said stud;

said guide bar being clamped between said side surface of said housing and said press-on surface of said sprocket wheel cover when said guide bar is in a mounted state;

said stud having a thickening defining a second diameter greater than said first diameter;

said guide bar having a slot-shaped opening formed therein wherein said thickening comes to rest in said mounted state thereof;

said free threaded end portion of said stud having a maximum usable screw-in depth ($t_{max}$) for said nut extending from said outermost end of said stud up to said thickening thereof;

a stop for said sprocket wheel cover;

said stop having a stop surface;

a support surface for contact engaging said stop surface;

said stop being configured separately from said side surface of said housing and from said press-on surface of said sprocket wheel cover;

said nut having an impermissible screw-in depth ($t_3$) when the following conditions are present: said sprocket wheel cover is mounted, said guide bar has been removed and said stop is not present;

said impermissible screw-in depth ($t_3$) is measured from said outermost end of said stud to said end of said nut facing toward said housing;

said stop surface being at a distance (a) to said support surface when said guide bar and said sprocket wheel cover are mounted and said nut is tightened;

said support surface contact engaging said stop surface of said stop when said guide bar is removed and said nut is screwed onto said stud to a stop screw-in depth ($t_2$);

said stop screw-in depth ($t_2$) being measured from said outermost end of said stud to said end of said nut facing said housing; and, said stop being so configured that said maximum usable screw-in depth ($t_{max}$) is greater than said stop screw-in depth ($t_2$).

2. The chain saw of claim 1, wherein said stud defines a longitudinal axis; said sprocket wheel cover defines said support surface corresponding to said stop surface; and, said stop surface and said support surface are at least approximately perpendicular to said longitudinal axis defined by said stud.

3. The chain saw of claim 1, wherein said stop is a head of a screw.

4. The chain saw of claim 1, wherein said stop is arranged on said sprocket wheel cover; said sprocket wheel cover has a cover edge in the region of said stop and said cover edge faces toward said housing; said stop projects out beyond said cover edge in a direction toward said housing; and, said support surface is arranged on said housing.

5. The chain saw of claim 1, wherein said stop is arranged on said housing; said stop projects out beyond said side surface of said housing; and, said support surface is arranged on said sprocket wheel cover.

6. The chain saw of claim 3, further comprising a side plate fixed on said housing as a support for said guide bar via said screw.

7. The chain saw of claim 1, wherein said guide bar has an opening into which said stop projects when said guide bar is mounted.

8. The chain saw of claim 1, wherein said distance (a) between said stop surface and said support surface is at least 0.2 mm.

9. The chain saw of claim 1, wherein said distance (a) between said stop surface and said support surface is at least 2.0 mm.

10. The chain saw of claim 1, wherein said nut is tightened to an operating screw-in depth ($t_1$) when said guide bar and said sprocket wheel cover are mounted; said operating screw-in depth ($t_1$) is measured from said outermost end of said stud to said end of said nut facing toward said housing; and, said maximum usable screw-in depth ($t_{max}$) is at least 1.5 mm greater than said operating screw-in depth ($t_1$).

11. The chain saw of claim 1, wherein said sprocket wheel cover has an opening; and, said nut is a captive, rotatable collar nut which is held in said opening of said sprocket wheel cover with play and has a collar; said collar has an end facing toward said housing and said collar is flanged over radially outwardly at said end thereof so as to cause said nut not to fall out of said opening in said cover; and, said end of said nut facing toward said housing is configured by said flanged over end thereof to determine said stop screw-in depth ($t_2$) and said impermissible screw-in depth ($t_3$).

12. The chain saw of claim 1, wherein said stud is a first stud and said nut is a first nut; and, said chain saw further comprises a second stud and a second nut corresponding thereto; and, said stop is disposed between said first and second studs.

* * * * *